United States Patent [19]

Maguire et al.

[11] Patent Number: 4,607,848

[45] Date of Patent: Aug. 26, 1986

[54] WORD GAME INVOLVING THE USE OF MOSAIC SCORE AND STRATEGY BOARDS

[76] Inventors: Hugh P. Maguire; Helen A. Maguire, both of 2092 Persimmon Ct., Cincinnati, Ohio 45231

[21] Appl. No.: 651,586

[22] Filed: Sep. 17, 1984

[51] Int. Cl.[4] ..... A63F 3/00

[52] U.S. Cl. ..... 273/269; 273/273

[58] Field of Search ..... 273/268, 269, 302, 265

[56] References Cited

U.S. PATENT DOCUMENTS

| | | | |
|---|---|---|---|
| 1,310,483 | 7/1919 | Korth | 273/269 |
| 3,143,348 | 8/1964 | Carsen | 273/302 X |
| 3,549,150 | 12/1970 | Weeks | 273/269 |
| 4,421,315 | 12/1983 | Cutler | 273/268 |

OTHER PUBLICATIONS

Gene Traub, "Going to Great Lengths", pp. 29, 68 of Jan./Feb. Games Magazine.

"Trivial Pursuit" game, rules and typical card only, ©1981.

*Primary Examiner*—Harland S. Skogquist

*Attorney, Agent, or Firm*—Frost & Jacobs

[57] ABSTRACT

A word game played for amusement involving the guessing of concealed words through definitional and phonetic clues. The outcome of a roll of die or other randomness means determines the set of definitional clues and single phonetic clues the player is to use. When the words are properly guessed, the player covers a score board space corresponding to the random number. As play progresses, the score board spaces become full and influence strategy. The first player to fill their score board wins.

2 Claims, 3 Drawing Figures

WORD GAME INVOLVING THE USE OF MOSAIC SCORE AND STRATEGY BOARDS

BACKGROUND OF THE INVENTION

Field Of The Invention

The present invention is a word game which utilizes definitional, trivia and phonetic clues in a way that will build the vocabulary of the participants while simultaneously providing amusement. The game involves the use of clue cards and a mosaic score board which affects strategy.

SUMMARY OF THE INVENTION

The invention is a game for two or more players competing individually. The game involves the guessing of concealed words based on definitional clues and phonetic clues. A mosaic board, which influences strategy, is used for keeping score. The object of the invention is to provide amusement while building the vocabulary of the game's participants.

The game involves the use of word cards which contain sets of clues on one side and the proper answers to those clues on the opposite side. A player rolls a die, the outcome of which directs the player to the appropriate clue set. The player then attempts to guess the answer words while an opponent, viewing the opposite side of the card, affirms or disaffirms the player's guesses. When the ultimate answer word of a clue set has been properly guessed, the player covers a space on this scoring device, referred to herein as a window board. The first player to cover all of the spaces on his or her window board wins the game.

DESCRIPTION OF THE PREFERRED EMBODIMENT

Figure 3:
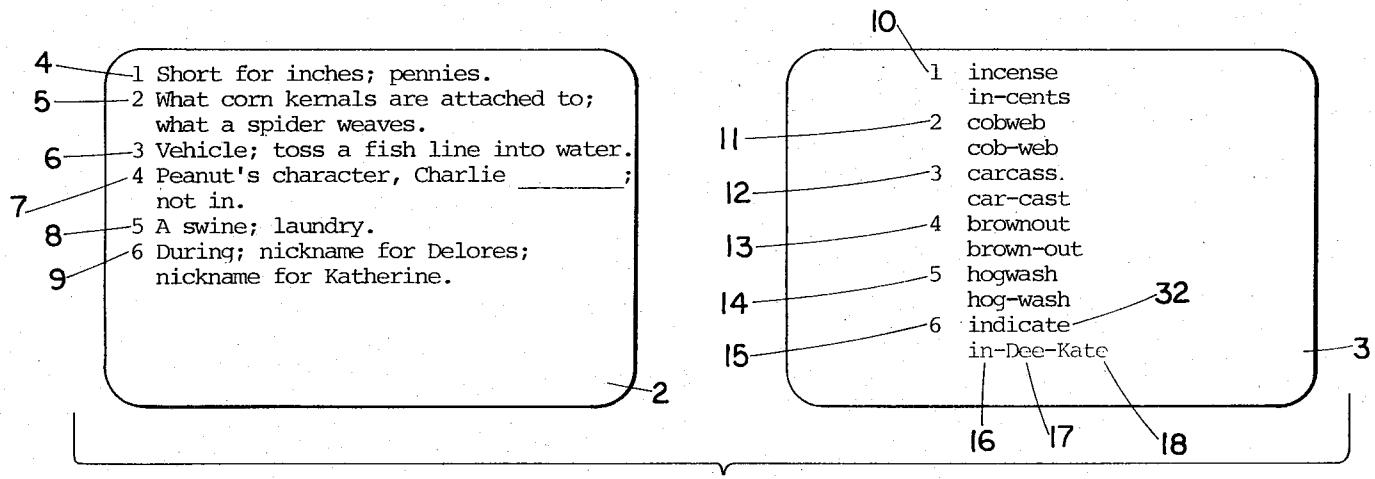
FIG. 3 is a front and back view of a typical word card.

The object of the game comprising the present invention is to guess words based upon definitional and phonetic clues. FIG. 3 shows the front and back sides, 2 and 3, respectively, of a sample word card 1 which contains clues and answers. Side 2 contains six sets of definitional clues, 4–9. Side 3 contains six sets of corresponding answer words, 10–15. Each answer word set contains two or more component answer words, for example, 16, 17 and 18 and one ultimate answer word, for example, 32.

An example of these word relationships can be seen by reference to clue set six identified on the drawing as number 9 of side 2. The clue set consists of three definitional interrogative clues: "During; nickname for Delores; nickname for Katherine." The corresponding answer set is number six identified on the drawing as item 15 of side 3. The answer set consists of the component answer words "in", (during) "Dee" (nickname for Delores) and "Kate" (nickname for Katherine), identified as items 16, 17 and 18 respectively, which combine to form the substantial phonetic equivalent of the ultimate answer word of that set, "indicate" (in-Dee-Kate), identified as item 19.

To begin play, a player rolls a die and picks a word card from a stack of word cards all of which are placed clue side up in a box. The player then guesses the component answer words associated with the set of clues which corresponds to the number rolled on the die. The player is allowed unlimited guesses at the component answer words and his guesses are affirmed or disaffirmed by an opponent player who looks at the answer side of the card.

For example, if the player were to roll a six on the die, that player would be required to attempt answers derived from clue set six—"During; nickname for Delores; nickname for Katherine." The player is then allowed an unlimited number of guesses at the correct component answer words—"in", "Dee" and "Kate".

When the player has guessed all or nearly all of the component answer words of the pertinent set, the player is entitled to one guess at the ultimate answer word of that set. For example, in set six, the player may successfully have guessed the component answer words "Dee" and "Kate" without yet having guessed the component answer word "in". The player may elect at that time or at any time to make a single guess at the ultimate answer word "indicate". If the player is incorrect, the player's turn comes to an end. If the player is correct, the player's turn comes to an end and a point is scored.

Figure 1:
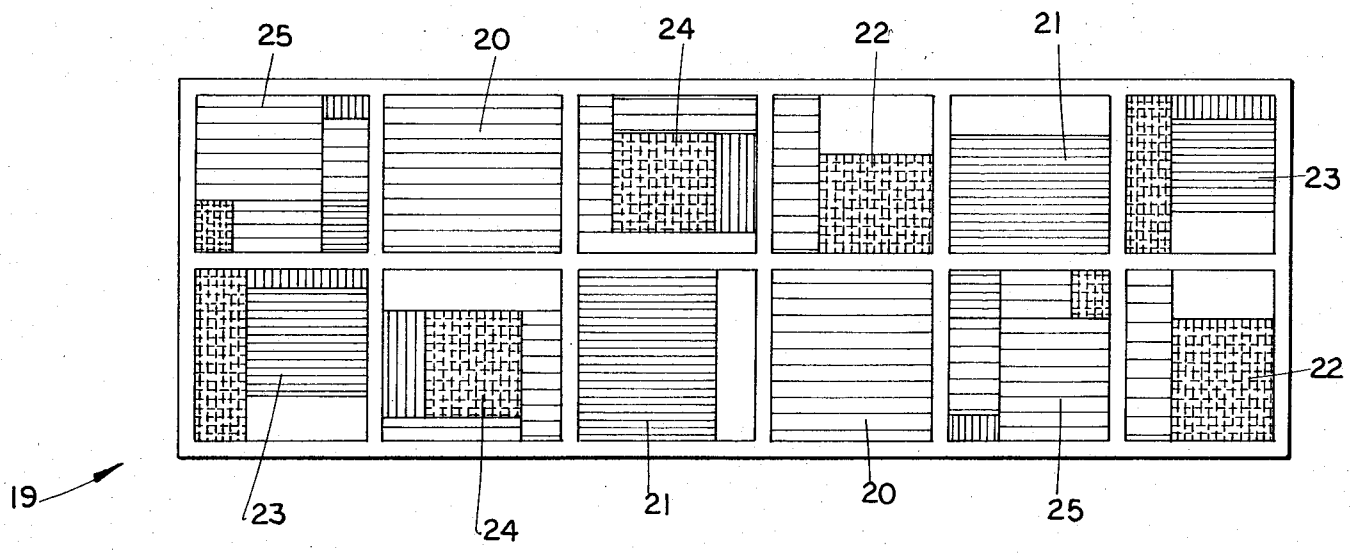
FIG. 1 is a top plan view of the window board used for keeping score.

Score keeping is by the window board 19 shown in FIG. 1. Each player is given a window board and each window board contains twelve regions, 21–25, each of which resembles a mosaic. Among the twelve regions, six distinct mosaic patterns appear. That is, each of the patterns 21–25 appears twice on the window board. Each of the patterns represents a number 1–6 which corresponds to one of the six sets of clues contained on a word card. For example, region 20, consisting of a single color, represents the number 1; region 21, containing two colors, represents the number 2; etc.

Figure 2:
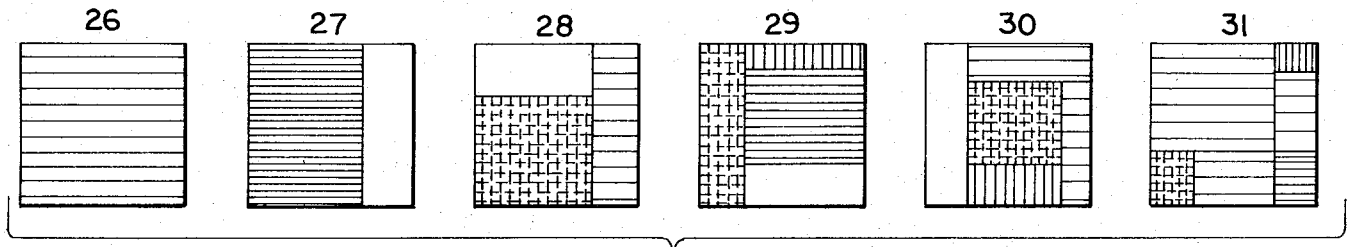
FIG. 2 is a top plan view of the window board cover pieces.

When a point is scored by correctly guessing the ultimate answer word, the player covers one of the two regions on the window board which corresponds to the set number from which the answer word clues were obtained, which, in turn, corresponds to the number rolled on the die. For example, if the player rolled a six on the die, that player would use clue set six with corresponding answer set six. If the player were to correctly guess the ultimate answer word of set six, "indicate", the player would cover one of the six color spaces on that player's mosaic board indicated in FIG. 1 as item 25. The player covers the mosaic board space with one of the matching word board cover pieces 26–31 shown in FIG. 2. The first player to completely cover his word board wins. The word board cover pieces bear a pattern substantially identical to the patterns found in the word board regions 20–25. These patterns range from a single color field to a six color field arranged as a mosaic. In each case, the number of colors corresponds to the number of the associated clue set.

As a player begins to successfully guess ultimate answer words and cover regions on his window board, the possibility exists that a player might roll a number for which both of his corresponding window board regions are covered by window board cover pieces. In such a case, the player can elect to guess the answer words from two sets of clues the set numbers of which combine to equal the number rolled on the die. For example, if a six is rolled and both of the six color spaces are covered, the player may elect to attempt clue sets two and four or one and five. However, since the player is limited to a single word card per turn, this strategy can be carried out only when the number rolled on the die is three or greater. Similarly, the player cannot elect the sets corresponding to the number which equals one half of the die number when an even number is rolled. For example, the player cannot elect to split a roll of six on the die into a pair of threes.

An example of this roll splitting can be seen by reference to the typical word card of FIG. 3. If the player were to roll a six and both of the six color regions on that player's window board were covered, the player could elect to attempt sets two and four with the ultimate answer words "cobweb" and "burnout", respectively; or, the player could elect to attempt sets one and five with the ultimate answer words "incense" and "hogwash". However, the player could not elect set three twice because the second attempt at the ultimate answer word "carcass" would be no challenge.

If, when attempting to split the roll in the manner described, the player wrongly guesses the ultimate answer word of either set, the player's turn ends and no points are awarded. For example, after rolling a six and electing sets two and four, even if the player has correctly guessed the ultimate answer word "cobweb" a subsequent wrong guess at the ultimate answer word "burnout" will result in the end of that player's turn with no points awarded. Also, because of the inability to split the roll when a number 1 or 2 is rolled and, in some cases, when an even number is rolled, a roll of such numbers causes the player to forfeit the turn.

It will be understood that variations of the present invention are possible using different groupings of the clues and more than one die. For example, each word card could be made to have two groups, A and B, each containing six sets of clues and, correspondingly, six sets of answer words. A player's choice of the set to use would be determined by rolling two die—one bearing the numbers one through six and the other having the letter A on three sides and the letter B on the remaining sides. The player would use the clue set corresponding to the group letter and set number which were rolled on the dice. All other aspects of the game would remain the same.

The present invention has been described in detail above by a specific example and in a specific embodiment for purposes of illustration only. The invention is not intended to be limited by this description.

What is claimed is:

1. A word game comprising:

a plurality of word cards, each card having on one side a plurality of clue sets each identified by a different unique number designation, each of said clue sets comprising at least one definitional interrogative clue, said card having on its opposite side a component answer for each of said clues and an ultimate word answer comprising the combination of said component answers combined in the same order as the associated clues to form the substantial phonetic equivalent of said ultimate answer word, each of said answers being identified by the same number designation as the associated clue set;

at least one die having a plurality of faces, each of said faces bearing one of said unique number designations; and scoring means for keeping score of the number of successful formations of ultimate answer words comprising at least one window board divided into a plurality of regions forming a mosaic pattern, each of said regions being divided into a number of differently colored areas equal in number to one of said unique number designations, and a plurality of window board cover pieces, each of said cover pieces being dimensioned to cover an associated one of said regions and containing a number of areas equal in color, number, size and shape to the colored areas on the associated region of said window board.

2. The word game according to claim 1 wherein said unique number designation is 6.

* * * * *